US006225903B1

(12) United States Patent
Soloway et al.

(10) Patent No.: US 6,225,903 B1
(45) Date of Patent: May 1, 2001

(54) ALARM SYSTEM ARMED AND DISARMED BY A DEADBOLT ON A DOOR

(75) Inventors: Richard Soloway; Jorge Hevia; Jerry Smith, all of Amityville, NY (US)

(73) Assignee: Napco Security Systems, Inc., Amityville, NY (US)

( * ) Notice: Subject to any disclaimer, the term of this patent is extended or adjusted under 35 U.S.C. 154(b) by 0 days.

(21) Appl. No.: 09/455,888

(22) Filed: Dec. 6, 1999

(51) Int. Cl.[7] ..... E05B 45/06

(52) U.S. Cl. ..... 340/542; 340/528; 340/541; 340/825.32; 307/10.5

(58) Field of Search ..... 340/542, 528, 340/825.32, 540, 506, 541, 527, 521, 522; 307/10.5; 180/287

(56) References Cited

U.S. PATENT DOCUMENTS 4,667,183 * 5/1987 Gaudio ..... 340/501
4,689,610 * 8/1987 Dietrich ..... 340/515
4,845,471 * 7/1989 Chu ..... 340/542
4,920,333 * 4/1990 Barr et al. ..... 340/545
5,268,671 * 12/1993 Novotny ..... 340/545
5,311,168 * 5/1994 Pease, Jr. et al. .
5,370,201 * 12/1994 Inubushi ..... 180/287
5,428,345 * 6/1995 Bruno ..... 340/541
5,434,556 * 7/1995 Donohoo ..... 340/547
5,801,625 * 9/1998 Wang ..... 340/506
5,805,064 * 9/1998 Yorkey ..... 340/550
5,977,873 * 11/1999 Woods ..... 340/547
6,097,106 * 8/2000 Roddy et al. ..... 307/10.5

* cited by examiner

*Primary Examiner*—Daniel J. Wu
*Assistant Examiner*—Phung Nguyen
(74) *Attorney, Agent, or Firm*—John R. Mugno

(57) ABSTRACT

A security alarm system which may be selectively armed or disarmed when monitoring a protected premises is described which utilizes the position of a deadbolt to determine whether the security system should be armed or disarmed. The security system comprises (i) an entry door for permitting ingress to the protected premises from the outside of the entry door and egress from the protected premises from the inside of the entry door; (ii) a lock for selectively locking and unlocking the entry door; and (iii) a switch having a first state indicative of the lock being in a locked position and a second state indicative of the lock being in an unlocked position wherein, when the switch is in its first state, the security system is armed and, when the switch is in its second state, the security system is disarmed. Sensing means are also provided to determine if the lock was engaged from inside or outside the protected premises. In the case where the lock was engaged from outside the premises and no authorized individual remains inside, sensors inside the premises would become activated. Conversely, in the case where the lock was engaged from inside the premises or from outside the premises and an authorized individual remains inside, the inside sensors would remain deactivated. The disabling of an inadvertent (false) alarm is easily, yet securely, achieved by activating a first user-controlled disarming means and returning the lock to its unlocked position.

71 Claims, 3 Drawing Sheets

ALARM SYSTEM ARMED AND DISARMED BY A DEADBOLT ON A DOOR

FIELD OF THE INVENTION

This invention is generally directed to residential and commercial alarm systems which are selectively armed and disarmed by a user. More specifically, the security alarm system of the present invention utilizes a modified deadbolt lock assembly that arms (or turns ON) an alarm system when the bolt is engaged, and disarms (or shuts OFF) the alarm system when the bolt is retracted. The alarm system of the present invention is capable of distinguishing which specific sensors should be bypassed when the bolt is engaged with no authorized person inside the premises, as opposed to when the bolt is engaged with an authorized person inside the premises.

BACKGROUND OF THE INVENTION

Burglaries, and the perceived risk thereof, have continually increased, particularly in crowded urban areas. Thus, more and more businesses and homes are protected by alarm systems. Most alarm systems comprise an alarm control panel; a series of detectors, sensors and/or door/perimeter contacts; and a user-controlled keypad. An alarm control panel typically includes all the necessary wiring and processing capability to determine whether signal information received from the detectors, sensors, contacts, etc. is indicative of an intruder. In more modern systems, the alarm control panel also provides the means for securing the telephone line in the house and dialing out to a central monitoring station if the processed signals are indicative of an intruder. A central monitoring station will then typically call the owner of the premises and, unless a proper secret code is provided, dispatch the police. The initial telephone call to the owner is not required but is usually done to confirm that the signal indicative of an alarm condition is not, instead, a false alarm. In certain municipalities, signals from the control panel may be sent directly to the police department or other municipal branch.

In the past, the provided keypad was often utilized for both installation and operational programming functions, and to permit a user to arm or disarm the alarm system. However, the programming of an installed alarm system is increasingly conducted via downloading directly to the alarm control panel from a hand-held device or from a remote location using a telephone connection. Thus, the keypad has become little more than a complicated and expensive "ON/OFF" switch.

In conventional alarm systems, when a user is ready to exit the premises and desires the alarm system to be turned ON (i.e., armed), a unique user code will be punched into the keypad. Typically, a delay is set that allows sufficient time for the user to exit the premises through the access door without setting off a false alarm. Conversely, when entering the premises, the user again must punch in a preselected code, utilizing the keypad, to disarm the alarm system. Again, a delay time is typically provided. If a user forgets or incorrectly inputs the preselected code and the delay time expires, an alarm condition will be initiated. Typically, an alarm condition will result in both an audio indication (such as a buzzer) and notification (via the telephone lines) to a central monitoring station.

Conventional keypad security systems are viewed unfavorably by users for a multiplicity of reasons. First, users need to remember their specific code and keep it secret. In order to permit authorized visitors access for a limited period of time (such as a house guest), a home or business owner must provide the access code yet would later need to change it to maintain security. Additionally, users often experience anxiety with the delay time permitted to enter a proper authorization code when either entering or exiting the premises. Many users, particularly elderly users, often lack the manual dexterity or the ability to view the keypad required to properly enter a code which allows them to enter the pre-established code. All of these shortcomings result in unnecessary false alarms which occur during the simple process of entering or exiting the premises.

It seems almost obvious to note that a very large majority of business and residential consumers who are concerned enough about security issues to purchase an alarm system, also utilize a deadbolt lock assembly on their access doors. While an alarm system is an effective deterrent against burglaries and indicates when an unauthorized individual (e.g., an intruder) has entered the premises, a reliable deadbolt lock assembly can prevent break-ins in the first place. Thus, the prior art does show some examples of an alarm utilized in conjunction with a deadbolt.

Droz U.S. Pat. No. 4,370,644 utilizes a deadbolt as a cut-off switch. The system presumes that when the deadbolt is retracted and in its unlocked position, an alarm condition signal should never be issued. The main advantage of this system is that it permits a user to leave the alarm system ON (or never shut the system OFF) while in the protected premises for an extended period of time. Although this system, under such circumstances, would normally detect the presence of an individual inside the premises and thus "see" an alarm condition, since the retracted deadbolt functions as an open switch, no actual alarm condition signal would be issued. The Droz device, however, provides no means for arming the alarm system by utilizing the deadbolt or insuring that both the deadbolt is engaged and the alarm system is ON when the user leaves the premises. Instead, false alarms are simply somewhat minimized due to the fact that no alarm condition can be initiated if the deadbolt is retracted. Furthermore, a user is permitted to set the alarm system well prior to leaving the premises as long as the deadbolt is not engaged. However, if the user leaves the premises without engaging the deadbolt, no alarm condition can ever be issued—whether the alarm system is armed or not.

Nourmand U.S. Pat. No. 4,937,560 provides an electromechanical interlock device that prevents a deadbolt from being moved from an unlocked position to a locked position until the security system is armed. Conversely, the provided electromechanical interlock also prevents the deadbolt from being moved from the locked position to the unlocked position until the security system is disarmed. The main function of the Nourmand device is to prevent false alarms and is accomplished by not allowing the user to enter the premises (since the deadbolt remains engaged) until the alarm system is turned OFF. The deadbolt is not utilized in any manner to arm or disarm the alarm system; instead, the permissible functioning of the deadbolt is modified depending on whether the alarm system is ON or OFF. The Nourmand device is, in effect, a deadbolt control. A glaring problem with the Nourmand device is that it is not adaptable to a door which an authorized person uses to enter the premises when the alarm is armed. The Nourmand system absolutely prevents the building from being entered prior to the security system being disarmed. However, most conventional alarm systems provide means for disarming an alarm inside the premises by setting an appropriate delay time.

Fromberg U.S. Pat. No. 5,925,861 provides a security door lock which is capable of issuing an alarm signal when an unauthorized user attempts to open a secured door. A cylindrical magnet contained within the latch permits the generation of an information signal which indicates that an attempt to open the secured door has been made. While the Fromberg device provides a separate door latch alarm, it is unrelated to any process of arming or disarming a home or business alarm system.

It is therefore a primary object of the present invention to provide a new and improved security alarm system.

It is another object of the present invention to provide a new and improved security alarm system which is less expensive and cumbersome than alarm systems using a keypad.

It is yet a further object of the present invention to provide a new and improved security alarm system that can be armed and disarmed based on the position of a deadbolt.

It is yet still a further object of the present invention to provide a new and improved security alarm system that can be armed and disarmed based on the position of a deadbolt and wherein the deadbolt's position is accurately detected by means of a Reed switch, a microswitch, or other means.

It is another object of the present invention to provide a new and improved security alarm system that can distinguish whether an authorized user is locking the deadbolt when leaving the protected premises or is locking the deadbolt while an authorized person remains inside the protected premises.

It is still another object of the present invention to provide a new and improved security alarm system that can be easily deactivated during a false alarm.

It is yet a further object of the present invention to provide a new and improved security alarm system that can easily be deactivated by a standard telephone utilizing its keypad.

It is yet still another object of the present invention to provide a new and improved security alarm system that is totally programmable without the utilization of a keypad.

It is still another object of the present invention to provide a new and improved security alarm system which is armed and disarmed dependent upon the position of a deadbolt, and which is further tamper proof.

It is yet another object of the present invention to provide a new and improved security alarm system that provides ease of installation.

It is still another object of the present invention to provide a new and improved security alarm system that can automatically determine whether to arm both perimeter and interior components when no authorized person remains in the protected premises or whether to arm only perimeter components when an authorized person remains in the premises.

Other objects and advantages of the present invention will become apparent from the specification and the drawings.

SUMMARY OF THE INVENTION

Briefly stated and in accordance with the preferred embodiments of the present invention, a security alarm system which may be selectively armed or disarmed when monitoring a protected premises is described which utilizes the position of a deadbolt to determine whether the security system should be armed or disarmed. The security system comprises (i) an entry door for permitting ingress to the protected premises from the outside of the entry door and egress from the protected premises from the inside of the entry door; (ii) a lock for selectively locking and unlocking the entry door; and (iii) a switch having a first state indicative of the lock being in a locked position and a second state indicative of the lock being in an unlocked position wherein, when the switch is in its first state, the security system is armed and, when the switch is in its second state, the security system is disarmed. Sensing means are also provided to determine if the lock was engaged from inside or outside the protected premises. In the case where the lock was engaged from outside the premises and no authorized individual remains inside, sensors inside the premises would become activated. Conversely, in the case where the lock was engaged from inside the premises or from outside the premises and an authorized individual remains inside, the inside sensors would remain deactivated. The disabling of an inadvertent (false) alarm is easily, yet securely, achieved by activating a first user-controlled disarming means and returning the lock to its unlocked position.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
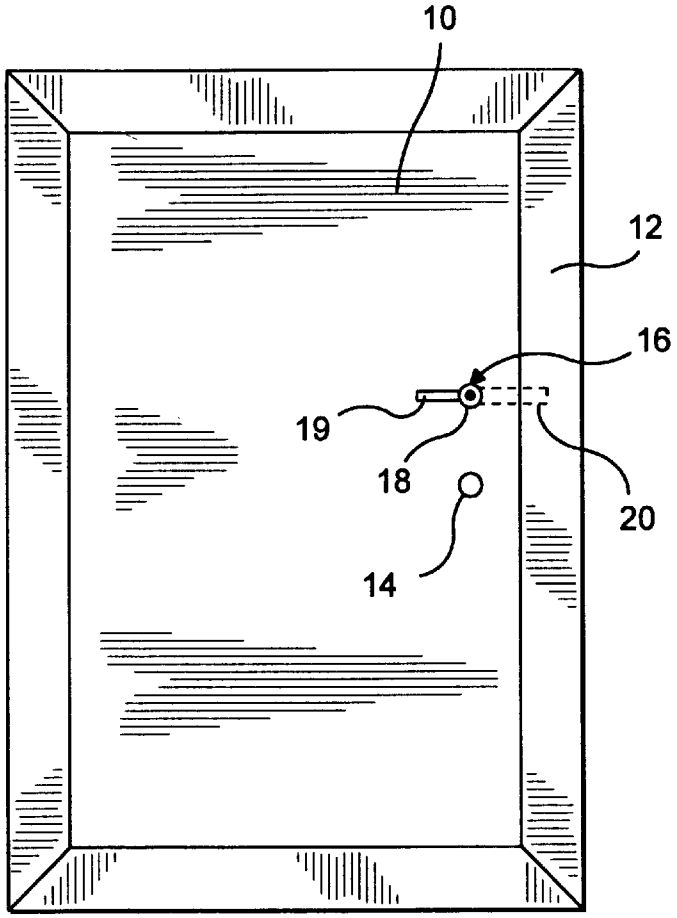
FIG. 1 is a schematic illustration of the outside of a secured door incorporating a security alarm system in accordance with the present invention.

Referring first to FIG. 1, a standard door 10 is shown which is hinged-mounted in a doorframe 12. A door handle 14 (depicted as a door knob) is on door 10 as well as a deadbolt lock assembly 16. Deadbolt lock assembly 16 includes a key chamber 18 which receives a key 19 and is operably connected to a bolt 20. Bolt 20 is operable to either retract within door 10 in its unlocked position or to extend from door 10 through a deadbolt hole of doorframe 12 in its locked position. FIG. 1 visually appears no different than the outside of any door incorporating a deadbolt lock assembly. However, the present invention may be utilized not only in conjunction with standard type mechanical deadbolts operated at least on one side by a key, but also with deadbolts that may be electronically controlled by a swipe card, a wireless keyfob, a keypad, etc.

Figure 2:
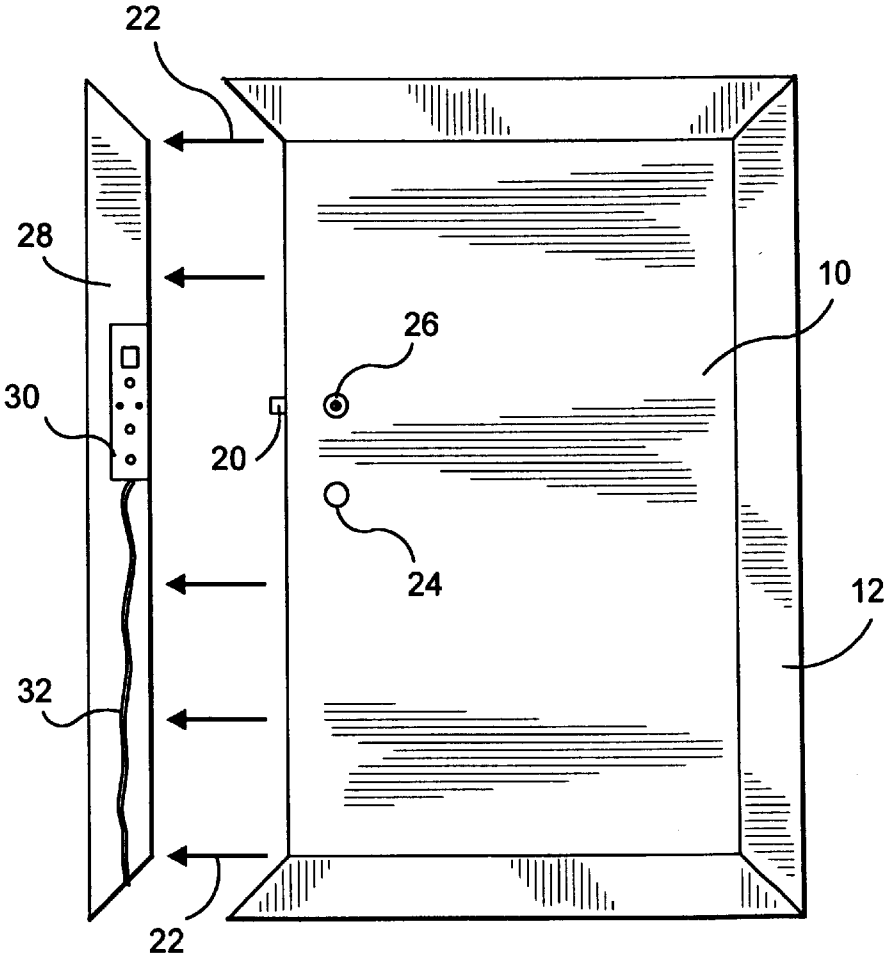
FIG. 2 is a schematic illustration of the inside of the secured door incorporating the security alarm system in accordance with the present invention.

Turning next to FIG. 2, the inside (or secured side) of door 10 and doorframe 12 is illustrated. The left side of doorframe 12 is shown exploded outwardly in the direction of directional arrows 22 in order to more clearly view bolt 20. Door 10 can be either opened or closed by a user by utilizing a door handle 24 when bolt 20 is in its retracted position. Bolt 20 can be placed in either its locked (extended) position or its unlocked (retracted) position by means of a thumb turn 26. Again, up to this point, FIG. 2 visually appears no different than a standard door utilizing a deadbolt lock assembly. In fact, it is preferred that most of the mechanical components of the present invention appear, and be able to be installed, as already known by installers. This easy adaptation will permit for easy retrofit applications.

A left panel 28 of doorframe 12 includes a deadbolt sensor command unit 30 which is hard wired to a power source by means of wires 32. Deadbolt sensor command unit 30 is more easily viewed in FIG. 3. In the preferred embodiment of the present invention, deadbolt sensor command unit 30 will include a light emitting diode (LED) display 34, a bypass icon 36 which can be visible on LED display 34, a panic button 38, a red "ARMED" LED 40, a green "READY" LED, a bypass toggle button 44, a zone bypass button 46, and an optional "EXIT/HOME" button 48. The use of each of the components of deadbolt sensor command unit 30 will be more readily understood when considered in connection with the description of the functionality of the present invention. However, proper utilization of the deadbolt sensor command unit 30 is dependent upon having an effective means for determining whether bolt 20 is in its locked (extended) or unlocked (retracted) position. Furthermore, when bolt 20 is in its locked position, it is essential to effectively determine whether the user has totally exited the premises (with no other authorized persons home) or simply secured the premises from within.

Figure 4:
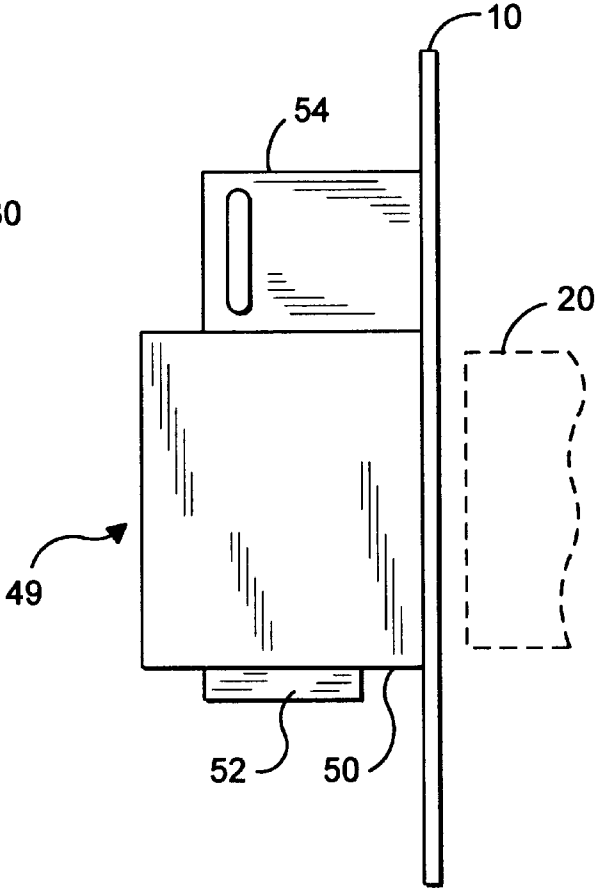
FIG. 4 is a first embodiment of a deadbolt position indicator switch of the security alarm system in accordance with the present invention.

FIG. 4 represents a first embodiment of an electromagnetic deadbolt position indicator switch 49 which can be utilized in conjunction with the present invention to determine whether bolt 20 is in its locked (extended) or unlocked (retracted) position. A bolt cup 50 is provided on the edge of door 10 and is shaped to receive bolt 20 when bolt 20 is in its locked position. A magnet 52 and a vertical Reed switch 54 are secured on opposite sides of bolt cup 50. When bolt 20 is in its locked position (i.e., it is within bolt cup 50), the magnetic flux between magnet 52 and vertical Reed switch 54 is interrupted. Under such conditions, the normally open Reed switch 54 will be in the position of FIG. 5 such that ON/OFF toggle switch 56 remains opened and the alarm system becomes armed. When bolt 20 is placed in its unlocked position (i.e., as depicted in FIG. 4), a magnetic flux is generated between magnet 52 and vertical Reed switch 54. Under such conditions, ON/OFF toggle switch 56 becomes closed and the alarm system becomes disarmed. Utilizing deadbolt position indicator switch 49 shown schematically in FIG. 4 and electrically in FIG. 5, a signal can be generated indicative of whether deadbolt 20 is in its locked or unlocked position.

Figure 5:
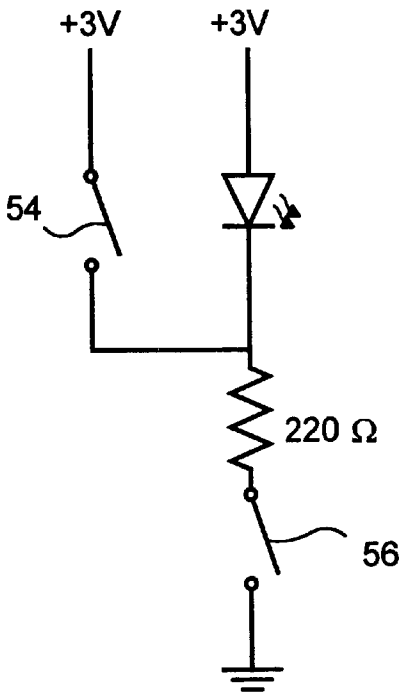
FIG. 5 is an electrical circuit diagram of the deadbolt position indicator switch of FIG. 5 in accordance with the present invention.

The deadbolt position indicator switch (or at least vertical Reed switch 54) of FIG. 4 and FIG. 5 must be sufficiently isolated so that deadbolt position indicator switch 49 cannot be tampered with by an intruder utilizing a large magnet. It will also be noted that deadbolt position indicator switch 49 of FIG. 4 advantageously includes no separately moving parts. Instead, the only actuation means is whether bolt 20 is in its locked or unlocked position. Furthermore, since the operation of deadbolt position indicator switch 49 of FIG. 4 is not dependent on any physical contact between bolt 20 and bolt cup 50, vertical Reed switch 54 will become closed even in the situation where bolt 20 is only partially inserted into bolt cup 50 and the key removed. This overcomes the common flaw associated with most deadbolt lock assemblies whereby a key can be removed even if the bolt is not completely extended in a locked position.

Figure 7:
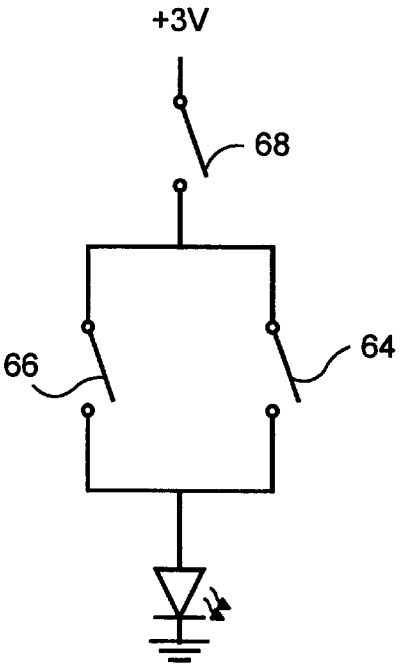
FIG. 7 is an electrical circuit diagram of the deadbolt position indicator switch of FIG. 6.
Figure 6:
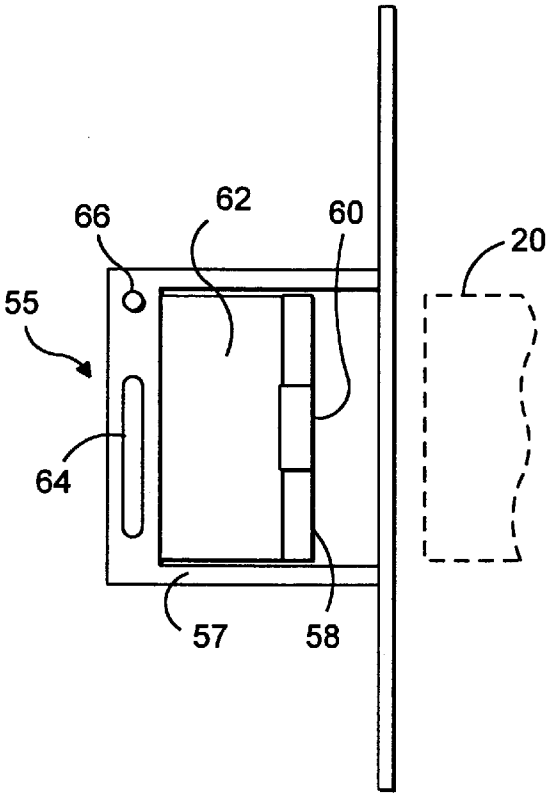
FIG. 6 is a second embodiment of a deadbolt position indicator switch of the security alarm system in accordance with the present invention.

FIG. 6 and FIG. 7 depict, respectively, a schematic and electrical circuit diagram of a second embodiment of a deadbolt position indicator switch 55 which may be utilized in accordance with the present invention. A bolt cup 57 is provided having a sufficient space in which bolt 20 can be inserted when in a locked position. A plastic holder 58 includes a magnet 60 which is movable based upon the pressure applied to a foam spacer 62. Deadbolt position indicator switch 55 of FIG. 6 includes both a normally open vertical Reed switch 64 and a normally open anti-tamper horizontal Reed switch 66. When bolt 20 is in its retracted (or unlocked) position (as shown in FIG. 6), both vertical Reed switch 64 and anti-tamper horizontal Reed switch 66 are in their open position, and thus, ON/OFF toggle switch 68 is also open as shown in FIG. 7 and the alarm system will be disarmed. When the deadbolt is put in its locked position by a key, a thumb turn, or other means, plastic holder 60 will compress foam spaces 62 and a magnetic flux between magnet 60 and vertical Reed switch 64 will be created. Under such circumstances, ON/OFF toggle switch 68 will become closed and the alarm system will become armed.

While the embodiment of deadbolt position indicator switch 55 shown in FIG. 6 and FIG. 7 is not as effective as deadbolt position indicator switch 49 of FIG. 4 and FIG. 5 in dealing with the situation whereby bolt 20 is only partially inserted within the bolt cup, it does not require the electromagnetic isolation required by deadbolt position indicator switch 49. Based on the parallel arrangement of vertical Reed switch 64 and anti-tamper horizontal Reed switch 66, any attempt by a would-be intruder to disarm the alarm by means of a large magnet would instead open vertical Reed switch 64 but close anti-tamper horizontal Reed switch 66 thereby still creating an armed system. In effect, any attempt to tamper with deadbolt position indicator switch 55 to disarm the alarm system would simply reverse the orientation of vertical Reed switch 64 and anti-tamper switch 66; the result is that ON/OFF toggle switch 68 remains closed and the alarm system remains armed.

Although the two deadbolt position indicator switches represented in FIGS. 4–7 represent the preferred means for determining the position of the lock, many alternative designs can be incorporated. For instance, any of a number of well-known microswitches could be utilized. Alternatively, an interrupted beam across the bolt cup could indicate a lock in its locked position whereas, conversely, an uninterrupted beam across the bolt cup would indicate a lock in its unlocked position.

Figure 8:
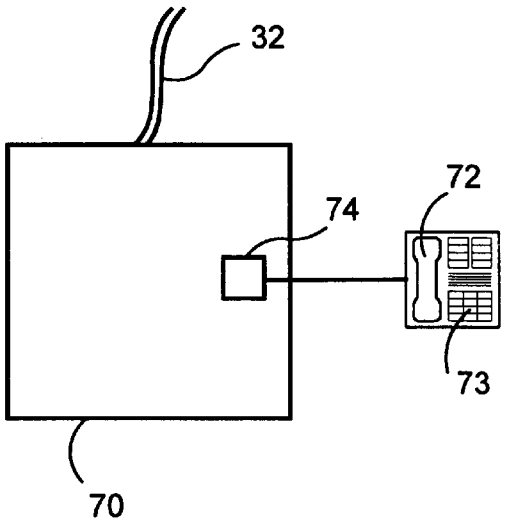
FIG. 8 is a schematic illustration of a control panel and telephone interconnection utilized in accordance with the present invention.

Turning next to FIG. 8, an alarm control panel 70 is shown which has been coupled to a standard telephone 72 having a keypad 73. Wires 32 are shown as the interconnection between panel 70 and deadbolt sensor command unit 30 for the example where they will share a common power source. A dual tone, multi-frequency (DTMF) decoder 74 has also been provided for purposes that will become apparent upon consideration of the functionality of the present invention, as described below.

In actual operation, a security alarm system should be armed and no separate zones faulted when no one is present in the protected premises. However, there are instances when users desire to arm the security alarm system even though certain zones will remain bypassed. Similarly, many users set their alarm system with bypass zones when present within the premises. Many various uses can be made; the present invention provides the user all the same options as conventional security alarm systems—without the use of the cumbersome and expensive keypad. A security alarm system typically includes numerous sensors comprising components that provide perimeter protection and components that provide interior protection. The interior protection components are often bypassed when the user is home.

Figure 3:
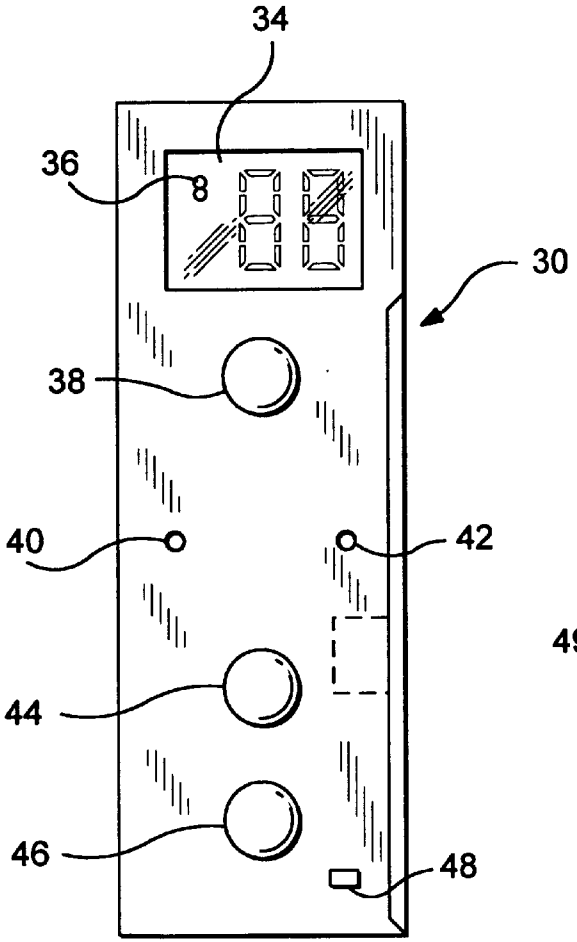
FIG. 3 is a schematic illustration of a preferred deadbolt sensor command unit utilized in conjunction with the security alarm system in accordance with the present invention.

The description of several functional uses of the present invention will effectively describe the components shown on deadbolt sensor command unit 30 of FIG. 3. The first example will be when a user wishes to exit the residence while the security alarm system is disarmed and certain zones are faulted. The user would approach door 10 and notice that neither the red "ARMED" LED 40 nor the green "READY" LED 42 is lit. The faulted zones will be scrolling slowly in the dual seven segment LED display 34. Any bypassed zones would be signified by the appearance of bypass icon 36 along with the appropriate zone number which indeed is bypassed. At this point, the user can check for faulted zones and take corrective actions such as closing windows, securing doors, etc. However, the user will not be forced to close bypass zones in order to arm the security alarm system. Once the user has addressed faulted zones as desired, the green "READY" LED 42 will be lit. At this point, the user can exit the door and lock the deadbolt from the outside. The system preferably will beep three distinct times signifying that the perimeter sensors have been armed. However, the interior sensors will preferably not be immediately activated. Instead, upon the locking of a deadbolt, the interior sensors will look to detect an individual in the premises for a predetermined delay time. If the interior sensors do not detect motion within the preselected delay time, the interior sensors will then arm. Alternatively, if the interior sensors do indeed detect motion within the preselected delay time, the interior sensor will be bypassed; the system will assume that the deadbolt had been engaged by a user inside the premises or that another authorized person remains in the premises.

While the aforementioned delay time is utilized to help the security alarm system of the present invention to determine whether bolt 20 had been engaged from inside or outside the premises, optional EXIT/HOME button 48 might also be implemented. If the user is engaging bolt 20 from inside the premises, he/she can first depress button 48 before engaging bolt 20. The system will be programmed to interpret such a scenario as being indicative of a locking from inside the premises, and therefore not arm the interior sensors. In the same way, EXIT/HOME button should be depressed when the person leaving the premises is indeed exiting, but another authorized person remains in the premises. Of course, optional EXIT/HOME button 48 can be programmed to work in reverse (i.e., wherein depression of the button is indicative of the locking of bolt 20 from outside the premises with no one remaining home).

The next example to be considered is when a user is exiting the residence, the security alarm system is armed, and certain zones are bypassed. Under such a scenario, the user will approach door 10 and notice that "ARMED" LED 40 is lit with the bypassed zones scrolling by slowly on LED display 34. Upon unlocking bolt 20 by means of thumb turn 26, the "READY" LED 42 would light. If zones are then faulted, the "READY" LED 42 would unlight and corrective action would have to be taken. After all corrective action is taken, the user would then exit door 10 and lock deadbolt assembly 16 by means of key 19 from outside door 10 to arm the system as described above.

When the user returns to the residence and desires to disarm the system, he/she would simply approach the front door, and unlock the deadbolt. The security alarm system would thus be disarmed. When the user actually opens door 10 and enters the premises "READY" LED 42 on deadbolt sensor command unit 30 would be lit.

A security alarm system must also be able to be armed when the user is at home or when he/she retires for the evening. Under such a scenario, the user would approach the door of the residence and if the "READY" LED 42 is lit, lock the deadbolt from the inside to arm the system. The system, under such circumstances, would monitor the interior for a preselected delay to determine if anyone is home or any pets are present. When properly functioning, the security alarm system would indeed detect the presence of the user inside the premises and the interior sensors would automatically be bypassed.

In conventional keypad security alarm systems, the keypad can also be utilized by a user to select bypass zones. The present invention can readily accomplish the same function without the need of a keypad. The user first would depress bypass toggle button 44. At that point, the security alarm system would present each faulted zone sequentially on LED display 34. If the user desired to bypass a particular zone, a user would hold down zone bypass button 46 for three seconds and the displayed zone would be bypassed. A chirping buzzer can be utilized to indicate that zone bypass button 46 has been depressed for a sufficient length of time (i.e., three seconds) to bypass the indicated zone. LED display 34 would then display the next faulted zone. If the user desired to skip the faulted zone and not bypass it, he/she would quickly depress zone bypass button 46 and the system would scroll to the next zone. Bypass toggle button 44 could then be pushed again to take the system out of bypass programming mode. If all faulted zones are bypassed or physically remedied, the system would automatically revert out of this bypass programming mode.

In any security alarm system, even an extremely passive one such as described herein, users will on occasion trip the alarm, thus causing a false alarm. An alarm condition signal would be indicated although in actuality the cause of this alarm condition was a false alarm. As stated above, control panel 70 would seize the telephone line and dial the central monitoring station. The central monitoring station would contact the user requesting the secret code developed by that user. Thus, the police would not be notified. However, until the alarm is disengaged, the actual siren at the location can be disturbing and embarrassing to the user. Even if the central monitoring station is equipped to deactivate the alarm, the overall security alarm system would then be out of synch since the alarm would be disarmed while bolt 20 was in a locked position.

The present invention is adaptable to provide numerous ways for a user to silence an inadvertent alarm. One way of accomplishing this task is by providing a disarm code similar to that established with keypad alarm security systems except that the code can be entered through the more familiar means of standard telephone 72 utilizing its keypad 73. The DTMF decoder is 74 can interpret these touchtone signals to disarm the system. However, in the preferred embodiment, the alarm still should not be completely silenced until the user also approached door 10 and unlocked bolt 20. Thus, the system would be disarmed and the bolt retracted, as is desired. Instead of utilizing standard telephone 72 using its keypad 73, a hidden kill switch, a keypad, a fingerprint reader, a retinal scanner, a wireless keyfob, etc. could also be provided when the user desires to disarm the system. In either of these instances, it would still be desirable to require the user to also retract the deadbolt before the alarm is silenced. This second step will ensure that the alarm system remains in "synch."

Whether utilizing a standard telephone using its keypad, a kill switch, a wireless keyfob, or other means, the security alarm system of the present invention could not be disarmed by an intruder simply by retracting the deadbolt once inside the premises. This system thus helps prevent "break and grab" burglaries wherein an intruder rapidly breaks into a secured premises, disables the audio alarm, quickly grabs desired items, and exits the premises prior to the time the police can respond to the alarm.

The one feature provided for on deadbolt sensor command unit 30 which, to this point, has not been described is panic button 38. Many users desire a simple means for immediately advising the central monitoring station that an emergency exists. Panic button 38 provides this feature. It should be noted by those skilled in the art that panic button 38 can be replaced with separate fire, police and emergency medical buttons (bearing appropriate icons) to dial the specific desired assistance.

It will be apparent from the foregoing description that the present invention provides a new and improved security alarm system which is easily installed and provides all the functions and features of keypad-activated security alarm systems. While a specific layout of various visual indicia, etc. has been provided, many variations may be utilized. For instance, the LEDs may be of various colors and, in fact, could be combined as a tri-color LED indicative of varying status. Moreover, any of the LEDs described herein can be replaced, or supplemented, by other indicator means including a voice annunciator and the like.

While there has been shown and described what is presently considered to be the preferred embodiments of this invention, it will be obvious to those skilled in the art that various changes and modifications may be made without departing from the broader aspects of this invention. For instance, although a deadbolt lock assembly has been shown, the invention could also be adapted to a latch which is key activated. Furthermore, while a standard door has been depicted, the subject invention can be incorporated on a window, garage door, or any other egress/ingress apparatus. Moreover, the subject invention can be utilized in either hardwired or wireless security alarm systems. Additionally, although a horizontally moving deadbolt has been depicted, a vertical deadbolt can also be utilized.

It is, therefore, aimed in the appended claims to cover all such changes and modifications as fall within the true scope and spirit of the invention.

We claim:

1. A multi-zone security system which may be selectively armed or disarmed for monitoring a protected premises comprising:

an entry door for permitting ingress to said protected premises from the outside of said entry door and egress from said protected premises from the inside of said entry door;

at least one zone of said security system which comprises an area of said protected premises away from said entry door;

a lock for selectively locking and unlocking said entry door; and a switch having a first state indicative of said lock being in a locked position and a second state indicative of said lock being in an unlocked position wherein, when said switch is in said first state, said security system is armed and, when said switch is in said second state, said security system is disarmed.

2. The security system of claim 1 wherein said lock is a deadbolt assembly.

3. The security system of claim 1 wherein said switch is a magnetic Reed switch.

4. The security system of claim 1 wherein said first state further comprises a first sub-state wherein only perimeter protection components of said security system are armed and a second sub-state wherein both said perimeter protection components and interior protection components of said security system are armed.

5. The security system of claim 1 further comprising:

a user-activated panic button in proximity to said door.

6. The security system of claim 1 further comprising:

means for disabling an inadvertent alarm.

7. The security system of claim 6 wherein said means for disabling an inadvertent alarm comprises a kill switch.

8. The security system of claim 6 wherein said means for disabling an inadvertent alarm com-prises a keyfob.

9. The security system of claim 6 wherein said means for disabling an inadvertent alarm comprises a telephone keypad coupled to a DTMF decoder.

10. The security system of claim 6 wherein said means for disabling an inadvertent alarm comprises a keypad.

11. A method of selectively arming or disarming a multi-zone security system having an entry door to a protected premises, at least one zone of said security system which comprises an area of said protected premises away from said entry door, and a lock for selectively locking and unlocking said entry door, said method comprising the steps of:

determining the position of said lock as being in a locked position or an unlocked position;

arming said security system when said lock is in said locked position; and disarming said security system when said lock is in said unlocked position.

12. The method of claim 11 wherein said arming step further comprises the sub-steps of:

arming only perimeter protection components of said security system when an authorized person remains inside the protected premises; and arming both said perimeter protection components and interior protection components of said security system when no authorized person remains inside the protected premises.

13. The method of claim 11 further comprising the step of:

disabling an inadvertent alarm.

14. The method of claim 13 wherein said disabling step comprises the sub-steps of:

activating a user-controlled disabling means; and moving said lock to said unlocked position.

15. The method of claim 14 wherein said disabling means comprises a kill switch.

16. The method of claim 14 wherein said disabling means comprises a keyfob.

17. The method of claim 14 wherein said disabling means comprises a telephone keypad coupled to a DTMF decoder.

18. The method of claim 14 wherein said disabling means comprises a keypad.

19. A method of selectively arming or disarming the security system having an entry door to a protected premises and a lock for selectively locking and unlocking said entry door, said method comprising the steps of:

determining the position of said lock as being in a locked position or an unlocked position;

disarming said security system when said lock is in said unlocked position;

establishing a time period commenced when said lock is placed in said locked position;

monitoring the interior of said protected premises during said time period to determine the presence of a person; and arming said security system when said monitoring step detects the presence of said person.

20. The method of claim 19 further comprising the step of:

disabling an inadvertent alarm.

21. The method of claim 20 wherein said disabling step comprises the sub-sets of:

activating a user-controlled disabling means; and moving said lock to said unlocked position.

22. The method of claim 21 wherein said disabling means comprises a kill switch.

23. The method of claim 21 wherein said disabling means comprises a keyfob.

24. The method of claim 21 wherein said disabling means comprises a telephone keypad coupled to a DTMF decoder.

25. The method of claim 21 wherein said disabling means comprises a keypad.

26. A multi-zone security system that may be selectively armed or disarmed for monitoring a protected premises comprising:

an entry door for permitting ingress to said protected premises from the outside of said entry door and egress from said protected premises from the inside of said entry door;

at least one zone of said security system which comprises an area of said protected premises away from said entry door;

a lock for selectively locking and unlocking said entry door; and a processing means capable of issuing a first signal indicative of said lock being in a locked position and a second signal indicative of said lock being in an unlocked position wherein said first signal arms said security system and said second signal disarms said security system.

27. The security system of claim 26 wherein said lock is a deadbolt assembly.

28. The security system of claim 26 wherein said first signal can be utilized to arm either only perimeter protection components of said security system or both said perimeter protection components and interior protection components of said security system.

29. The security system of claim 26 further comprising:

a user-activated panic button in proximity to said door.

30. The security system of claim 26 further comprising:

means for disabling an inadvertent alarm.

31. The security system of claim 30 wherein said means for disabling an inadvertent alarm comprises a kill switch.

32. The security system of claim 30 wherein said means for disabling an inadvertent alarm comprises a keyfob.

33. The security system of claim 30 wherein said means for disabling an inadvertent alarm comprises a telephone keypad coupled to a DTMF decoder.

34. The security system of claim 30 wherein said means for disabling an inadvertent alarm comprises a keypad.

35. A method of disabling an inadvertent alarm of a multi-zone security system having an entry door to a protected premises, at least one zone of said security system which comprises an area of said protected premises away from said entry door, and a lock on said entry door selectively moveable to a locked position or an unlocked position, said method comprising the steps of:

activating a user-controlled disarming means; and moving said lock to said unlocked position.

36. The method of claim 35 wherein said disarming means comprises a kill switch.

37. The method of claim 35 wherein said disarming means comprises a keyfob.

38. The method of claim 35 wherein said disarming means comprises a telephone keypad coupled to a DTMF decoder.

39. The method of claim 35 wherein said disarming means comprises a keypad.

40. A security system which may be selectively armed or disarmed for monitoring a protected premises comprising:

an entry door for permitting ingress to said protected premises from the outside of said entry door and egress from said protected premises from the inside of said entry door;

at least one zone of said security system which comprises an area of said protected premises away from said entry door;

an alarm panel remotely located from said entry door and capable of issuing an alarm signal when said security system is armed;

a lock for selectively locking and unlocking said entry door; and a switch having a first state indicative of said lock being in a locked position and a second state indicative of said lock being in an unlocked position wherein, when said switch is in said first state, said security system is armed and, when said switch is in said second state, said security system is disarmed.

41. The security system of claim 40 wherein said lock is a deadbolt assembly.

42. The security system of claim 40 wherein said switch is a magnetic Reed switch.

43. The security system of claim 40 wherein said first state further comprises a first sub-state wherein only perimeter protection components of said security system are armed and a second sub-state wherein both said perimeter protection components and interior protection components of said security system are armed.

44. The security system of claim 40 further comprising:

a user-activated panic button in proximity to said door.

45. The security system of claim 40 further comprising:

means for disabling an inadvertent alarm.

46. The security system of claim 45 wherein said means for disabling an inadvertent alarm comprises a kill switch.

47. The security system of claim 45 wherein said means for disabling an inadvertent alarm comprises a key fob.

48. The security system of claim 45 wherein said means for disabling an inadvertent alarm comprises a telephone keypad coupled to a DTMF decoder.

49. The security system of claim 45 wherein said means for disabling an inadvertent alarm comprises a keypad.

50. A method of selectively arming or disarming a security system having an entry door to a protected premises, at least one zone of said security system which comprises an area of said protected premises away from said entry door, a lock for selectively locking and unlocking said entry door, and an alarm panel remotely located from said entry door and capable of issuing an alarm signal when said security system is armed, said method comprising the steps of:

determining the position of said lock as being in a locked position or an unlocked position;

arming said security system when said lock is in said locked position; and disarming said security system when said lock is in said unlocked position.

51. The method of claim 50 wherein said arming step further comprises the sub-steps of:

arming only perimeter protection components of said security system when an authorized person remains inside the protected premises; and arming both said perimeter protection components and interior protection components of said security system when no authorized person remains inside the protected premises.

52. The method of claim 50 further comprising the step of:

disabling an inadvertent alarm.

53. The method of claim 52 wherein said disabling step comprises the sub-steps of:

activating a user-controlled disabling means; and moving said lock to said unlocked position.

54. The method of claim 53 wherein said disabling means comprises a kill switch.

55. The method of claim 53 wherein said disabling means comprises a key fob.

56. The method of claim 53 wherein said disabling means comprises a telephone keypad coupled to a DTMF decoder.

57. The method of claim 53 wherein said disabling means comprises a keypad.

58. A security system that may be selectively armed or disarmed for monitoring a protected premises comprising:

an entry door for permitting ingress to said protected premises from the outside of said entry door and egress from said protected premises from the inside of said entry door;

at least one zone of said security system which comprises an area of said protected premises away from said entry door;

an alarm panel remotely located from said entry door and capable of issuing an alarm signal when said security system is armed;

a lock for selectively locking and unlocking said entry door; and a processing means capable of issuing a first signal indicative of said lock being in a locked position and a second signal indicative of said lock being in an unlocked position wherein said first signal arms said security system and said second signal disarms said security system.

59. The security system of claim 58 wherein said lock is a deadbolt assembly.

60. The security system of claim 58 wherein said first signal can be utilized to arm either only perimeter protection components of said security system or both said perimeter protection components and interior protection components of said security system.

61. The security system of claim 58 further comprising:

a user-activated panic button in proximity to said door.

62. The security system of claim 58 further comprising:

means for disabling an inadvertent alarm.

63. The security system of claim 62 wherein said means for disabling an inadvertent alarm comprises a kill switch.

64. The security system of claim 62 wherein said means for disabling an inadvertent alarm comprises a key fob.

65. The security system of claim 62 wherein said means for disabling an inadvertent alarm comprises a telephone keypad coupled to a DTMF decoder.

66. The security system of claim 62 wherein said means for disabling an inadvertent alarm comprises a keypad.

67. A method of disabling an inadvertent alarm of a security system having an entry door to a protected premises, at least one zone of said security system which comprises an area of said protected premises away from said entry door, a lock for selectively locking and unlocking said entry door, and an alarm panel remotely located from said entry door and capable of issuing an alarm signal when said security system is armed, said method comprising the steps of:

activating a user-controlled disarming means; and moving said lock to said unlocked position.

68. The method of claim 67 wherein said disarming means comprises a kill switch.

69. The method of claim 67 wherein said disarming means comprises a key fob.

70. The method of claim 67 wherein said disarming means comprises a telephone keypad coupled to a DTMF decoder.

71. The method of claim 67 wherein said disarming means comprises a keypad.

* * * * *